United States Patent [19]

Rivette et al.

[11] 4,279,100

[45] Jul. 21, 1981

[54] SOUNDING TOY

[75] Inventors: Denni F. Rivette, Chicago; Burton C. Meyer, Downers Grove; Donald F. Nix, Hanover Park, all of Ill.

[73] Assignee: Marvin Glass & Associates, Chicago, Ill.

[21] Appl. No.: 79,944

[22] Filed: Sep. 28, 1979

[51] Int. Cl.[3] ..... A63H 5/00; G10D 7/00; A63H 33/00

[52] U.S. Cl. ..... 46/179; 84/330; 46/1 A

[58] Field of Search ..... 46/178, 179, 175 R, 46/174, 1 A, 180, 181, 177, 44; 84/330

[56] References Cited

U.S. PATENT DOCUMENTS

| | | | |
|---|---|---|---|
| 2,646,646 | 7/1953 | Glass | 46/1 A |
| 2,837,862 | 6/1958 | Cleveland | 46/1 A |
| 2,912,791 | 11/1959 | Cohen | 46/175 R |
| 2,988,848 | 6/1961 | Lemelson | 46/175 R |
| 3,002,318 | 10/1961 | Carver | 46/179 |
| 3,390,483 | 7/1968 | Doe | 46/1 A |
| 3,487,741 | 1/1970 | Ethridge | 84/330 |
| 3,813,811 | 6/1974 | Herter | 46/180 |
| 4,114,501 | 9/1978 | Tanaka | 46/179 |
| 4,194,461 | 3/1980 | Kubiatowicz | 46/175 R |
| 4,207,703 | 6/1980 | Saso | 46/177 |

*Primary Examiner*—G. E. McNeill
*Assistant Examiner*—Michael J. Foycik, Jr.
*Attorney, Agent, or Firm*—Mason, Kolehmainen, Rathburn & Wyss

[57] ABSTRACT

A sounding toy for producing musical tones and other sounds includes a reciprocating element which may be repetitively struck by the user in order to produce the sounds. The sounding toy includes a vertically reciprocating cylindrical member which moves within an aperture in the housing in a generally vertical direction. The travel of the cylindrical member is defined by the longitudinal axis of a piston secured to the interior of the housing. A deformable, hollow engagement member is mounted on the top of the cylindrical member and allows for repeated contact by the hand or a hand-held tool of the user. A sound producing mechanism, such as a whistle, is mounted or formed integrally on the cylindrical member in fluid communication with the deformable engagement member. A downward vertical force on the engagement member will cause compression or deformation thereof and force air or other fluid through the whistle moving the cylindrical member downwardly within the housing over the piston. Air leakage between the piston and the internal diameter of the cylindrical member permits several engagements of the engagement member by the user to move the cylindrical element downwardly its full length of travel. In the preferred embodiment, a second, similar assembly is pivotally connected to the first cylindrical member by a centrally pivotal lever mounted within the housing. The lever arrangement connects the two cylindrical portions such that movement of one cylindrical member into the housing causes an opposite movement of a second cylindrical member outwardly relative to the housing.

15 Claims, 3 Drawing Figures

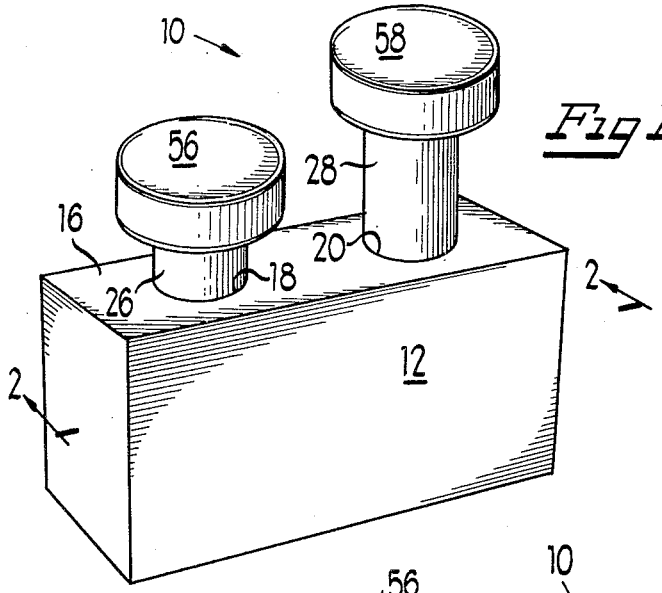
Fig 1
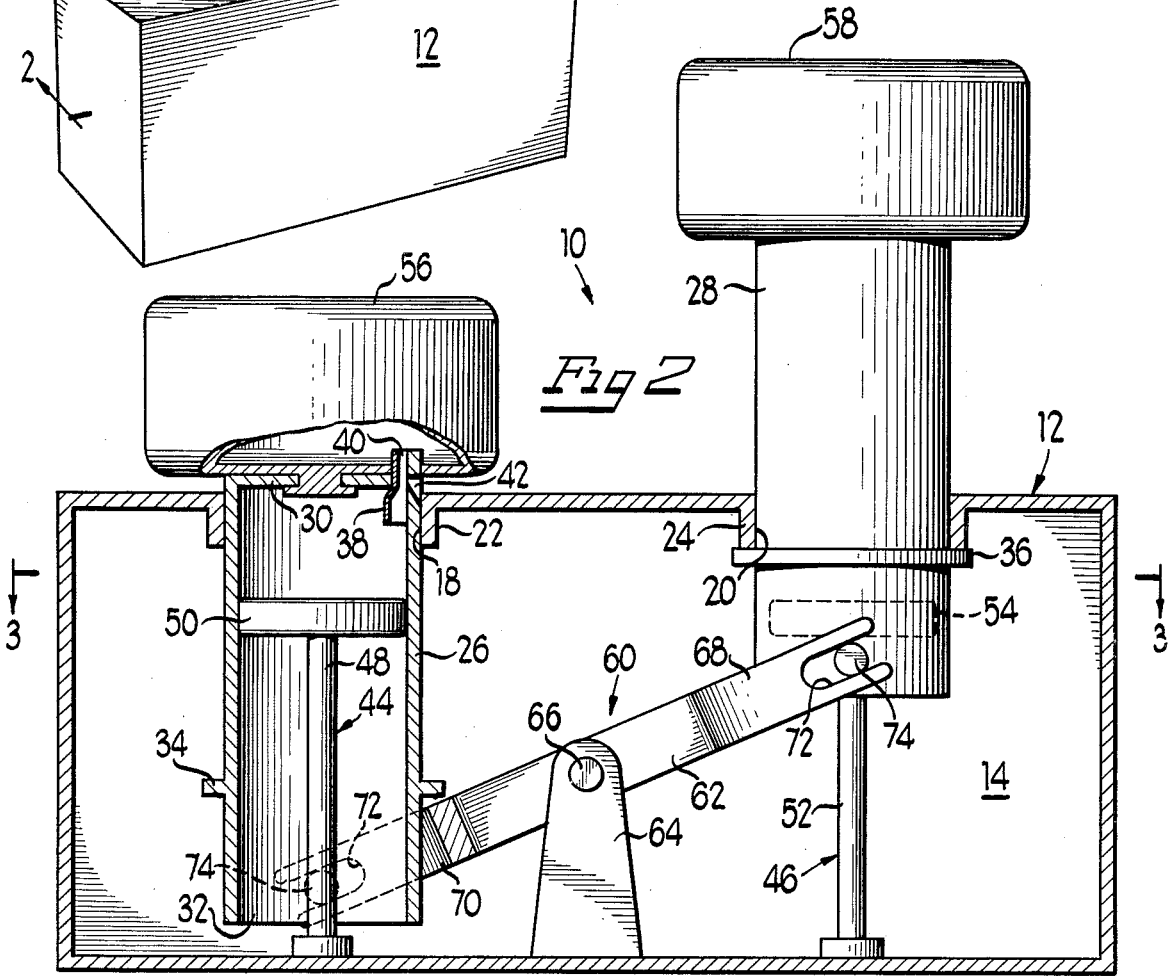
Fig 2
Fig 3
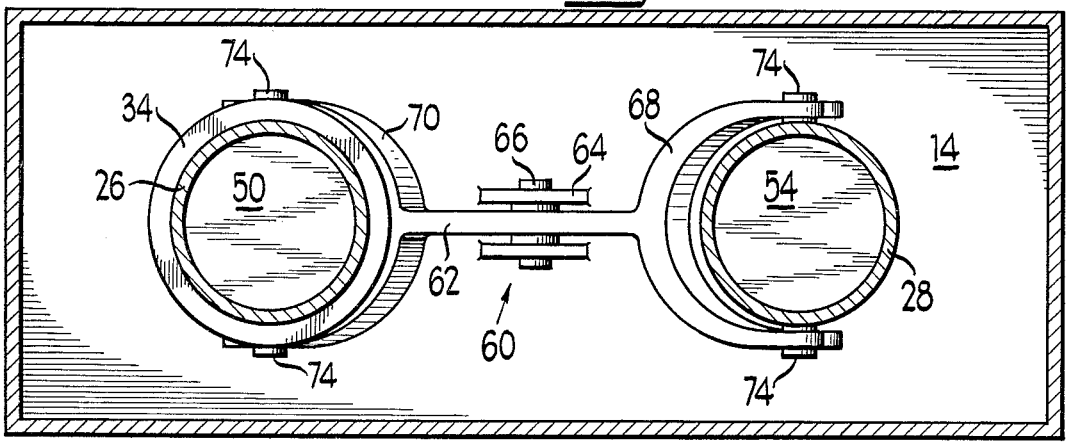

SOUNDING TOY

BACKGROUND OF THE INVENTION

1. Field of the Invention

The present invention relates to a new and improved sounding toy.

2. Brief Description of the Prior Art

One of the more entertaining types of toys for small children are those that combine both action and sounds such as musical or other types of audible signals. Both the sound and action attract the child to the toy, maintaining his interest over long periods of time. In addition, a sounding toy that a child must operate or develop actions to produce a desired sound assists in the development of the child's reflexes, coordination and motor skills as well as providing certain educational advantages. Such toys must be durable and capable of being operated many times without damage or destruction. Thus, the action that produces the sound for the sounding mechanism must be simple, durable and at the same time entertaining to its user.

SUMMARY OF THE INVENTION

An object of the present invention is to provide a new and improved sounding toy.

Another object of the present invention is to provide a new and improved action toy that produces entertaining musical sounds or tones.

A further object of the present invention is to provide a new and improved action toy which produces sound and is durable and simple in construction. The present invention is directed to a sounding toy for producing musical tones and other sounds includes a reciprocating element which may be repetitively struck by the user in order to produce the sounds. The sounding toy includes a vertically reciprocating cylindrical member which moves within an aperture in the housing in a generally vertical direction. The travel of the cylindrical member is defined by the longitudinal axis of a piston secured to the interior of the housing. A deformable, hollow engagement member is mounted on the top of the cylindrical member and allows for repeated contact by the hand or a hand-held tool of the user. A sound producing mechanism, such as a whistle, is mounted or formed integrally on the cylindrical member in fluid communication with the deformable engagement member. A downward vertical force on the engagement member will cause compression or deformation thereof and force air or other fluid through the whistle moving the cylindrical member downwardly within the housing over the piston. Air leakage between the piston and the internal diameter of the cylindrical member permits several engagements of the engagement member by the user to move the cylindrical element downwardly its full length of travel. In the preferred embodiment, a second, similar assembly is pivotally connected to the first cylindrical member by a centrally pivotal lever mounted within the housing. The lever arrangement connects the two cylindrical portions such that movement of one cylindrical member into the housing causes an opposite movement of a second cylindrical member outwardly relative to the housing.

BRIEF DESCRIPTION OF THE DRAWINGS

The above and other objects and advantages and novel features of the present invention will become apparent from the following detailed description of a preferred embodiment of the invention illustrated in the accompanying drawing wherein:

FIG. 1 is a perspective view of a toy constructed in accordance with the principles of the present invention;

FIG. 2 is an enlarged view taken generally along line 2—2 of FIG. 1; and FIG. 3 is a view taken generally along line 3—3 of FIG. 2.

DESCRIPTION OF THE PREFERRED EMBODIMENT

With reference to the drawings, there is illustrated a sounding toy for producing musical tones or other sounds, generally designated by the reference numeral 10. The toy 10 is intended to entertain a child by requiring action or movement to produce a desired sound, such as a whistle.

In the preferred embodiment illustrated, the toy 10 includes a housing 12 that is an enclosed rectangular box defining an internal air chamber 14. The housing 12 includes a top 16 with first and second apertures 18 and 20 defined therein each with encircling flanges 22 and 24, respectively. Slideably mounted in each of the apertures 18 and 20 are first and second cylinders 26 and 28 that are closed at one end, such as end 30 of cylinder 26 and open at the other end, such as end 32 of cylinder 26 (FIG. 2). The dimensions of the cylinders 26 and 28 relative to the apertures or openings 18 and 20 are such that the cylinders 26 and 28 move freely within the apertures 18 and 20. However, the cylinders 26 and 28 cannot be removed from the housing 12 since cylinders 26 and 28 include flanges 34 and 36, respectively, that engage the flanges 22 and 24 upon reaching the upwardmost position of the cylinders 26 and 28.

On the inner peripheral surface of each cylinder 26 and 28 and extending through the upper end, such as end 30 of the cylinder 26, is a whistle or slotted tube 38 that is open at an upper end 40 and the lower end is in communication with the interior volume above the piston 50. Cylinder 26 is placed over a piston 44 and cylinder 28 is positioned over a piston 46. Piston 44 includes a rod 48 and a piston head 50 whereas piston 46 includes a rod 52 and a piston head 54. A slot 42 permits the escapement of some air and a whistle sound as the cylinder 26 moves downwardly.

As can be understood, the piston head 50 and 54 are close fit in the cylinders 26 and 28 and by moving the cylinders 26 and 28 downwardly in the housing 12 around the piston heads 50 and 54, respectively, air is forced slowly around the piston heads 50 and 54 requiring several engagements with or pushes on the cylinders 26 and 28 to move them into the housing 12.

To allow the child operating the toy 10 to force the cylinders 26 and 28 into the housing 12, each cylinder 26 and 28 includes deformable engagement members 56 and 58, respectively, mounted thereon. The engagement members 56 and 58 are hollow in construction and deformable to force air through the upper end 40 of the whistles 38 and through the slots 42 upon engagement by the child thus producing musical or other sounds. A whistling sound is produced upon each engagement with the member 56 or 58 in moving the cylinder 26 or 28 into the housing 12. Each movement of the cylinder 26 or 28 changes the interior volume within the cavity above the piston. By virtue of this change in volume, each striking of the engagement member 56 causes a different pitch whistle sound to be produced increasing the entertainment value of the toy.

In order to insure that one of the cylinders 26 or 28 is in a ready position to be engaged by the child operating the toy 10 to produce a sound, a lever assembly, generally designated by the reference numeral 60, is included in the toy 10. The lever assembly 60 includes a lever 62 pivotally mounted to a bracket 64 by a pin 66. The lever 62 includes at both ends thereof a clevis 68 and 70 including slots 72 within which are positioned pins 74 that are defined on the outer peripheral surfaces of the cylinders 26 and 28. By the connection through the lever assembly 60, when the cylinder 26 is down within the housing 12, the cylinder 28 has been moved upwardly to a position whereupon the flange 22 engages the flange 24. Conversely, movement of the cylinder 28 into the housing 12 moves the cylinder 26 out of the housing 12. Accordingly, as a child continues to engage the engagement member 58, for example, the cylinder 28 is forced into the housing 12 and air inside the member 58 is forced through a similar whistle causing a variable pitch whistling sound to be produced that is entertaining to the child. Simultaneously, through the action of the lever assembly 60, the cylinder 26 is moved upwardly out of the housing 12 until the flange 34 engages the flange 22. This cycle of operation can be repeated with entertaining sound and action being developed by the toy 10 that is enjoyed by the child.

Many modifications and variations of the present invention are possible in light of the above teachings. Thus, it is to be understood that, within the scope of the appended claims, the invention may be practiced other than as specifically described above.

What is claimed and desired to be secured by Letters Patent of the United States is:

1. A variable pitch sounding toy comprising:
- a housing;
- a first variable volume chamber within said housing;
- a second variable volume chamber within said housing;
- an air actuated sounding mechanism in fluid communication with said first and second chambers;
- an engageable element operatively connected to said first chamber to vary the volume of said first chamber forcing air into said second chamber through said sounding mechanism;
- a movable member operatively connected to said element to vary the volume of said second chamber, and a cylinder connected to said first chamber and slidably mounted within said housing, said second chamber defined within the interior of said cylinder, said toy further including a piston slidably mounted within said cylinder and fixed to said housing defining said second chamber within said cylinder.

2. The toy of claim 1 including a second cylinder slidably mounted within said housing.

3. The toy of claim 2 including a pivotal member connecting said cylinder to said second cylinder so that said cylinders reciprocate in opposite directions within said housing when said engageable element is engaged.

4. The toy of claim 3 including a second piston slidably mounted within said second cylinder and attached to said housing defining a third variable volume chamber within said second cylinder.

5. The toy of claim 4 wherein said first chamber is a resilient chamber.

6. The toy of claim 5 including a second resilient chamber connected to said second cylinder and a second air actuated sounding mechanism in fluid communication with said third chamber and said second resilient chamber.

7. The toy of claim 6 including a second engageable element operatively connected to said third chamber.

8. The toy of claim 7 wherein said first engageable element is a surface of said first chamber and said second engageable element is a surface of said second resilient chamber.

9. A variable pitch sounding toy comprising:
- a housing;
- a first cylinder reciprocable within said housing;
- a second cylinder reciprocable within said housing;
- a pivotal member connected between said first and second cylinders;
- a pair of pistons fixed to said housing, each slideably mounted within one of said cylinders, defining a chamber within each cylinder;
- a pair of deformable chambers each connected atop one of said cylinders; and
- a pair of air actuated sounding mechanisms, each connected between one of said deformable chambers and said chambers within each cylinder.

10. A variable pitch sounding toy comprising:
- a housing;
- a first variable volume chamber within said housing;
- a second variable volume chamber within said housing;
- an air actuated sounding mechanism in fluid communication with said first and second chambers;
- an engageable element operatively connected to said first chamber to vary the volume of said first chamber forcing air into said second chamber through said sounding mechanism;
- a movable member operatively connected to said element to vary the volume of said second chamber, a cylinder connected to said first chamber and slidably mounted within said housing, said second chamber defined within the interior of said cylinder, said toy further including a piston slidably mounted within said cylinder and fixed to said housing defining said second chamber within said cylinder, a second cylinder slidably mounted within said housing, and
- a second piston slidably mounted within said second cylinder and attached to said housing defining a third variable volume chamber within said second cylinder.

11. The toy of claim 10 including a pivotal member connecting said cylinder to said second cylinder so that said cylinders reciprocate in opposite directions within said housing when said engageable element is engaged.

12. The toy of claim 10 wherein said first chamber is a resilient chamber.

13. The toy of claim 12 including a second resilient chamber connected to said second cylinder and a second air actuated sounding mechanism in fluid communication with said third chamber and said second resilient chamber.

14. The toy of claim 13 including a second engageable element operatively connected to said third chamber.

15. The toy of claim 14 wherein said first engageable element is a surface of said first chamber and said second engageable element is a surface of said second resilient chamber.

* * * * *